US006142229A

United States Patent [19]

Branson, Jr. et al.

[11] Patent Number: 6,142,229

[45] Date of Patent: Nov. 7, 2000

[54] METHOD AND SYSTEM FOR PRODUCING FLUIDS FROM LOW PERMEABILITY FORMATIONS

[75] Inventors: Aubrey G. Branson, Jr.; Michael Patrick Kelly, both of Bakersfield, Calif.; Robert S. Swain, Plano, Tex.

[73] Assignee: Atlantic Richfield Company, Chicago, Ill.

[21] Appl. No.: 09/154,360

[22] Filed: Sep. 16, 1998

[51] Int. Cl.[7] ..... E21B 47/00; E21B 43/00

[52] U.S. Cl. ..... 166/250.15; 166/53; 166/369

[58] Field of Search ..... 166/250.15, 252.1, 166/373, 53, 263, 369, 320

[56] References Cited

U.S. PATENT DOCUMENTS

| | | | |
|---|---|---|---|
| 4,645,005 | 2/1987 | Ferguson | 166/303 |
| 4,676,313 | 6/1987 | Rinaldi | 166/252.1 |
| 4,685,522 | 8/1987 | Dixon et al. | 166/372 |
| 4,807,704 | 2/1989 | Hsu et al. | 166/117.5 |
| 4,828,031 | 5/1989 | Davis | 166/275 |
| 4,953,618 | 9/1990 | Hamid et al. | 166/305.1 |
| 4,989,671 | 2/1991 | Lamp | 166/53 |
| 5,085,276 | 2/1992 | Rivas et al. | 166/308 |
| 5,132,904 | 7/1992 | Lamp | 700/282 |
| 5,305,829 | 4/1994 | Kumar | 166/252.1 |
| 5,335,730 | 8/1994 | Cotham, III | 166/374 |
| 5,377,756 | 1/1995 | Northrop et al. | 166/303 |
| 5,411,086 | 5/1995 | Burcham et al. | 166/270.1 |
| 5,415,231 | 5/1995 | Northrop et al. | 166/308 |
| 5,429,191 | 7/1995 | Schmidt et al. | 166/308 |
| 5,472,050 | 12/1995 | Rhoten et al. | 166/281 |
| 5,832,996 | 11/1998 | Carmody et al. | 166/53 |
| 5,927,401 | 7/1999 | Morris et al. | 166/64 |
| 5,957,199 | 9/1999 | McLean et al. | 166/250.15 |
| 5,967,234 | 10/1999 | Shaposhnikov et al. | 166/373 |
| 6,000,468 | 12/1999 | Pringle | 166/53 |
| 6,006,832 | 12/1999 | Tubel et al. . | |

*Primary Examiner*—David Bagnell
*Assistant Examiner*—Jennifer R. Dougherty
*Attorney, Agent, or Firm*—James A. Gabala; Robert E. Sloat

[57] ABSTRACT

A method and system for producing hydrocarbons from a low permeability formation through a well wherein the formation is first fractured with steam. The pressure of the produced fluids is measured at timed intervals and signals representative of these measurements are inputted into a computer which, in turn, calculates the rate of change in the pressure and compares this rate to a preferred limit of rate change. When the limit is exceeded, the computer outputs a signal to adjust a control value in the production line to keep the rate of pressure decrease within the preferred limit. When production drops below a certain level, the control valve is fully opened to "bump" the well and allow the pressure to increase to a new maximum. This new maximum pressure is then used to set a new preferred limit of pressure rate change.

11 Claims, 5 Drawing Sheets

METHOD AND SYSTEM FOR PRODUCING FLUIDS FROM LOW PERMEABILITY FORMATIONS

BACKGROUND OF THE INVENTION

The present invention relates to a control system for production of oil from a low permeability formation using a floating set point control system.

Substantial reserves of oil are known to exist in reservoirs having very low permeability. Billions of barrels of oil of proven reserves are known to be trapped in diatomaceous reserves in California. Hydrocarbon bearing diatomite formations are unique because they often have high oil saturation and high porosity, but have little permeability. Diatomite formations contain significant amounts of oil, but few fractures through which oil could flow and be recovered.

Several methods have been used for producing diatomaceous reserves, and these low permeability oil reserves present a number of operational problems for oil recovery. It is extremely difficult to inject fluids essential for pressure maintenance and/or improved oil recovery into diatomite formations. The conflict between prudent reservoir management and meeting field injection and production targets has resulted in injectant recirculation and irreversible damage to reservoirs and wells, leaving oil that is unrecoverable through known technologies.

To compensate for low permeability, wells in diatomite formations are fluid fractured. A typical well has three to eight vertical fractures with tip-to-tip wingspans of about 300 feet. Even after fluid fracturing, traditional water flooding methods have suffered from low injectivity, poor sweep, and unwanted hydrofracture extensions. However, steam flooding has proven to be a more attractive recovery technique. Steam flooding provides better results because oil recovery occurs by both thermal expansion of oil through heat conduction and direct replacement of oil by steam and hot water entering oil-filled pore space. However, due to the subsidence and compaction characteristics of the diatomaceous reservoirs, the fractures have a tendency to close as fluids are withdrawn from the reservoir, which also decreases the permeability of the formation before recovery operations can be completed.

A number of different methods have been suggested for improving the recovery of oil from diatomite formations. U.S. Pat. No. 4,167,470 discloses a hydrocarbon solvent which is contacted with diatomite ore from a mine in a six stage extraction process. The adverse economical and environmental factors have prevented any significant acceptance of this process.

An alternative method is disclosed in U.S. Pat. No. 4,485,871, which teaches a method of recovering hydrocarbons from diatomite in which an alcohol is injection into the formation followed by an aqueous alkaline solution. However, many of the diatomite formations do not respond to this type of stimulation. U.S. Pat. No. 4,828,031 describes the injection of a solvent into the diatomite followed by a surface active aqueous solution. The solution contains a diatomite-oil water wettability improving agent and surface tension lowering agent. The method is enhanced by the injection of steam into the diatomite formation.

U.S. Pat. No. 4,645,005 describes a production technique for heavy oils in unconsolidated reservoirs, as opposed to diatomite formations. The formation may be fracture stimulated with steam prior to completion by conventional gravel pack. After the gravel pack is completed, the well is periodically stimulated by injection of steam at a pressure below that which would result in fracture of the reservoir.

The production of oil from low permeability formations by sequential steam fracturing is disclosed in U.S. Pat. No. 5,085,276. The heating of the formation water and its flashing from a liquid to a gas phase upon reducing well bore pressures when returning to the production mode produces significantly increased quantities of oil from the formation. The flashing effect continues within the wellbore as pressure reduces within the wellbore, thus aiding the flow of liquid to the surface for recovery from the wellbore.

Imbibition processes for diatomite formations are disclosed in U.S. Pat. No. 5,411,086 and U.S. Pat. No. 5,415,231. In the '231 patent, slugs of steam are injected into the formation in decreasing amounts. Between steam injections, the well is shut in and allowed to soak for ten days or more. The production cycle is based solely on time and not on pressure changes. In the '086 patent, enhanced imbibition is accomplished by adding chemical additives to the injection fluid so that rock in the tight reservoir has a stronger affinity for the water present therein, thus releasing oil from the rock.

U.S. Pat. No. 5,377,756 describes a method for oil recovery from diatomite formations using a single wellbore. Upper and lower intervals are fractured from the wellbore such that the fractured intervals only partially overlap. A partial, natural barrier is formed along the interface between the fractured intervals. The partial barrier improves the sweep efficiency of a drive fluid which is injected into the lower fractured interval by forcing it to spread outward into the reservoir before it flows through the upper fracture interval.

U.S. Pat. No. 5,472,050 discloses a method for increasing production from a low permeability formations by fracturing a production interval in the formation and restricting the release of pressure from the fracture to lengthen the time that the reservoir pressure remains above the fracture collapse pressure. The difference between the reservoir pressure and the wellbore pressure is diminished, which provides for some increase in the length of the production interval. This method continuously restricts the release of pressure during the production operations in order to avoid flashing.

Because there are still significant oil reserves located in diatomite formations, and because of the significant difficulties of recovering such oil reserves in an economical manner, there is still a need and desire for improved methods of producing oil from such low permeability formations.

In diatomite formations, production is not necessarily optimized by maximizing the lift, which is the difference between the reservoir pressure and the wellbore pressure. On the other hand, continuously restricting the release of pressure may increase the length of production time, but does not optimize such production by achieving a higher production rate at a reasonable cost. An improved control system is needed which optimizes production by monitoring the rate of pressure decline in the production operations and selectively unloading the well to increase lift during the production operations.

SUMMARY OF THE INVENTION

The present invention provides an improved control system and method for producing oil from diatomite formations and other low permeability formations. The present invention optimizes oil production by monitoring changes in the pressure after steam has been injected into the well at sufficient pressure to create fractures. The pressure is measured in the well casing at the surface of the well. This pressure reading provides a reasonable approximation of the pressure in the reservoir. After the steam operation is completed and the steam valve closed, the production valve is opened and production operations begin. The pressure is continuously monitored and the rate of pressure change is calculated by the computer. If the rate of change for the pressure exceeds a specified upper limit for the rate of change, the control valve is adjusted to keep the rate of change in the pressure within acceptable limits. In most cases, the pressure will be dropping and the valve we be closed further and further to maintain pressure. In some cases, such as a well surge, the pressure will increase and the valve will be maintained in the same position to build up pressure. After a period of operation within the desired pressure range, the valve closure will reduce production rates. At such a point, the well is bumped or unloaded by opening the control valve to the full open position to increase the pressure for a specified period of time.

After each time the well is bumped, a new set point is established and production is resumed. The rate of change in pressure is based on the new set point and the valve positioning is controlled to maintain the desired rate of change. During one production operation of an operating cycle, the well is bumped numerous time to maintain the desired rate of pressure change. The production operation continues until the reservoir pressure at the producing interval is approximately equal to the pressure on the production group line. When the pressure has dropped and production has been discontinued, steam is applied for an extended period of time and the operating cycle is repeated again and again until the production rate is no longer acceptable.

By monitoring pressure and limiting large decreases in the pressure of the reservoir, higher flow rates and/or longer production cycles can be achieved as compared to similar wells which are operated based on set time schedules or based on continuous pressure restriction. The pressure will decrease over time, and expected pressure decay curves can be estimated for the various wells. One of the problems with large pressure drops is that the overall production output for a cycle will be decreased. The decrease in pressure will typically cause the production time to decrease. By periodically bumping (unloading) the well, the pressure drop can be stabilized and operations can be maintained along the desired pressure curve for the cycle.

During an operating cycle, the expected decrease in pressure is greatest during the initial operation right after steam is applied for an extended period of time at the start of a production interval. The rate of change in the pressure decreases during the production operations. During the first day or two of productions operations, the rate of pressure declines is quite rapidly. The production operations may last for more than twenty days, and the rate of pressure decline tapers off towards the end of such production operations. The flow rate on the system can also be monitored. Once the flow rate has reached a specified minimum production level, production operations can be closed down and the operating cycle is repeated. Steam operations are initiated to increase the pressure for the next production operation.

The cycle will be repeated over and over again for the intervals in the formation adjacent the wellbore. The number of cycles varies depending on the size and characteristics of the well, but certain intervals in the formation can still provide acceptable production levels after more than one hundred cycles.

Production operations for wells are often constrained by the capacity of the centralized processing facilities, such as steam equipment. The computer used for set point monitoring and valve control could also be used to allocate steam from the existing steam facilities. Production rates steam usage for various wells in a field can be monitored and input into the computer. If the demand for steam exceeds the supply, the system of the present invention can allocate steam to optimize production rates.

In some cases, the wells utilizing the control system of the present invention will be multi-completion wells in which multiple wellbores are extended from a common wellhead. When steam is transmitted to one wellbore in a multi-completions well, the adjacent wellbores may experience an increase in pressure because of the heat transfer between wellbores. Pressure increases may also be experienced in the control system due to well surging production. The control system detects such pressure increases and adjusts the control valves to benefit from such favorable pressure increases.

BRIEF DESCRIPTION OF THE DRAWINGS

The present invention may be better understood by reading the following detailed description of the preferred embodiments, with reference to the accompanying drawings, wherein.

DESCRIPTION OF THE PREFERRED EMBODIMENT

Figure 1:
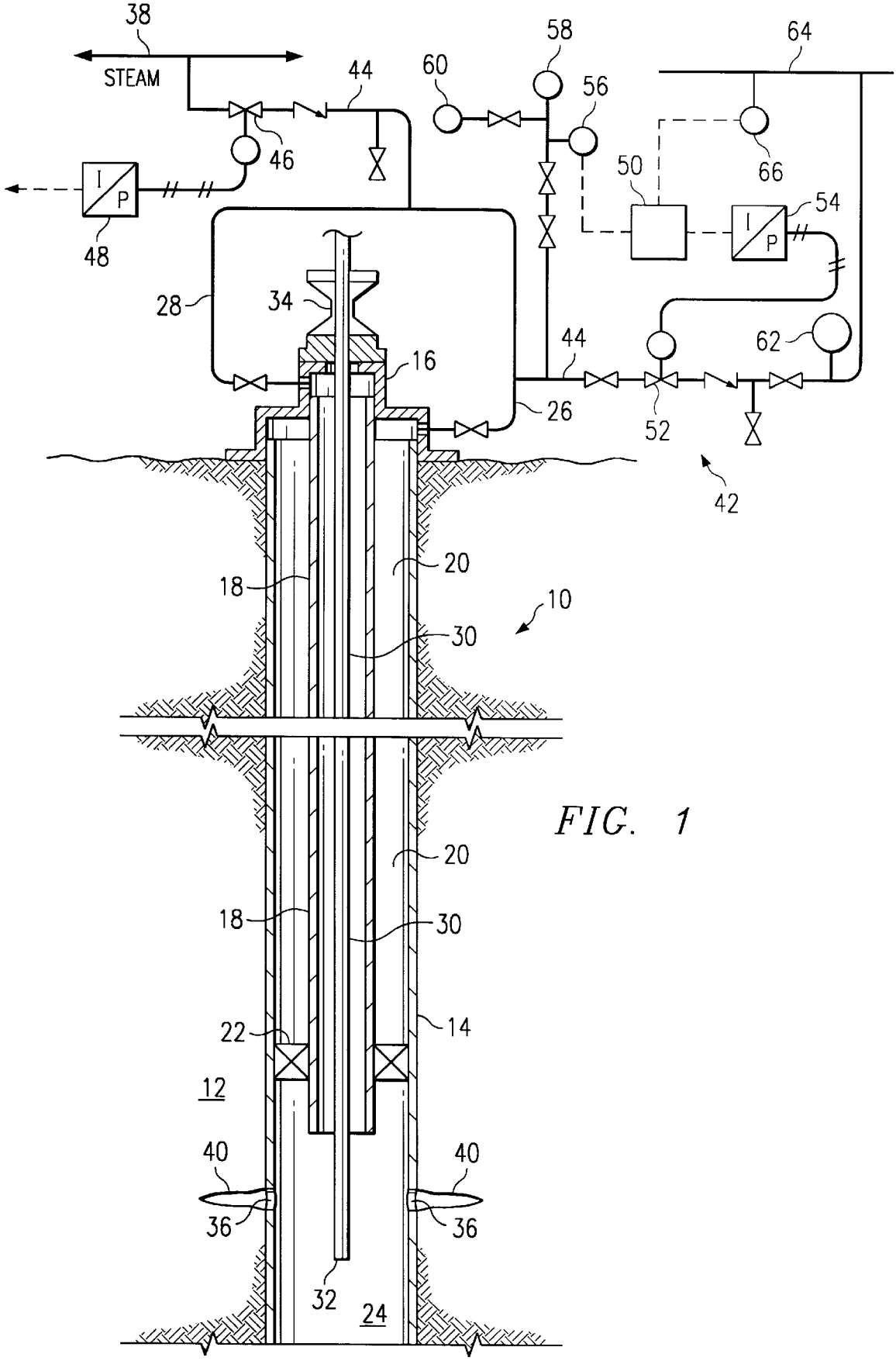
FIG. 1 is a schematic diagram of an oil recovery process and the control system embodying features of the present invention.

Referring to FIG. 1, a well 10 has been drilled into an earth formation 12. The formation 12 is a diatomite formation having no significant natural fractures. The well 10 includes a conventional casing 14, wellhead 16, and production tubing string 18 extending from the wellhead 16. Insulated tubing may be used in the tubing string 18. An annular space 20 is formed between the casing 14 and tubing string 18 and is isolated by a packer 22. The packer 22 is preferably a thermal packer, but a conventional packer may also be used. The casing 14 defines a wellbore space 24 into which the tubing string 18 extends. Suitable fluid conducting conduits 26 and 28 are in communication with the annular space 20 and the interior of the tubing string 18, respectively, through the wellhead 16.

An elongated tubing 30 has been inserted through the wellhead 16 and interior of the tubing string 18 and having an end 32 extending into the wellbore space 24 extending below the end of the tubing string 18. The tubing 30 is inserted into the wellhead 16 through a conventional movable closure 34. The tubing 30 is a coilable type which may be withdrawn from the tubing string once the casing 14 has been perforated. The perforations 36 may be formed by use of conventional tools, such as Schlumberger's Ultrajet Gun or the like.

In diatomite formation and other low permeability formations, an individual well is used both as an injection well and as a production well. The operating cycle of the well includes a steam-injection operation and a production operation. The steam operation time and the volume of fracturing fluid to be used to fracture the formation depends on the available capacity of the steam supply and the properties of the formation. Although other fracturing fluids may be used, steam is the preferred heated fluid because of its high heat content per unit mass as well as its high rate of heat transfer associated with condensation with the condensed steam providing the vehicle for imbibition. The steam reduces the viscosity of the hydrocarbons in the rock matrix of the formation and it increases the wettability of the rock matrix, thereby leading to greater production from the formation. As the pressure in the formation is reduced during the production operation, the unpropped fractures to close and push fluids out of the fracture and towards perforations 36.

With the packer 22 and tubing string 18 set, steam from a surface steam supply source 38 is directed through conduit 28 and tubing string 18 at sufficient pressure to create fracture 40 in the diatomite formation adjacent the perforations 36. After the steam operation, the imbibed fluids are produced from the fractures 40 and through the perforations 36 and tubing string 18 and conduit 28. Sufficient reservoir pressure typically exists following the steam operation that a wellbore pump is not required to lift production fluids to the surface during the production operation. As the pressure in the formation continues to decrease during the production operation, a pump (not shown) may be used to increase the production of oil from the tubing string.

In the steam operation, the volume of steam should be large enough to fracture and fill both the induced and natural fractures 40 within the reservoir with steam. The volume may be estimated from the known characteristics and properties of the reservoir being produced. The steam operation time is generally 1–4 days with about 2–3 days being the preferred steam operation time. Typically, the amount of fracturing fluid employed during the steam operation is between 500 to about 5,000 barrels of water converted to wet steam. The preferred volume is in the range between 2,000 and 3,000 barrels.

The control system 42 for monitoring and controlling the operating cycle, including the steam operation and the production operation, is also shown in FIG. 1. Steam is supplied from the steam supply line 38 and a steam control valve 46 is opened to permit the flow of steam through conduit 44 and conduit 28 into the tubing string 18. The conduit 26 is normally maintained in a closed condition, but may be opened to allow steam access to the annular space 20 if needed. The control valve 46 is typically a pneumatic control valve connected to an actuator 48. The actuator 48 is in communication with the computer or programmable logic controller 50 such that the opening and closing of the valve is controlled from a remote location. Solenoid valves and snap motor valves could be used in this application. Although pneumatic devices are disclosed, electrical control devices may also be used for controlling the operation of the valves. The increased availability (and lower cost) of "smart" devices, such as control valves and transmitters, will also improve the production operations and trouble shooting capabilities of the present invention. The control valves discussed in the present control system 42, for example, could be smart valves having their own microprocessor and interface, and being equipped with self diagnostics, remote calibration and other operating features which facilitate more accurate remote operation and control.

Once the steam operation phase of the operating cycle is completed, the steam control valve 46 in conduit 44 is closed and the production control valve 52 is opened by actuator 54 to start the production operation. A short time delay of 15–30 minutes may be programmed before the opening of the control valve 52. The actuator is connected to and controlled by the computer 50 for operation of the control valve 52. During the operating cycle, the control valve 52 is typically closed during the steam operation and open during the production operation.

The instrumentation connected to conduit 44 includes a pressure sensor (transducer) 56 for monitoring the pressure in conduit 44 and generating a signal which is transmitted to the computer 50. A meter 58 and pressure release valve 60 are also provided. A flow meter 62 may also be included to measure the production flow from the well 10 by generating a signal which is transmitted to the computer 50. The conduit 44 directs the production flow from the well 10 to other oil production facilities, such as separators and storage tanks (not shown).

Figure 2:
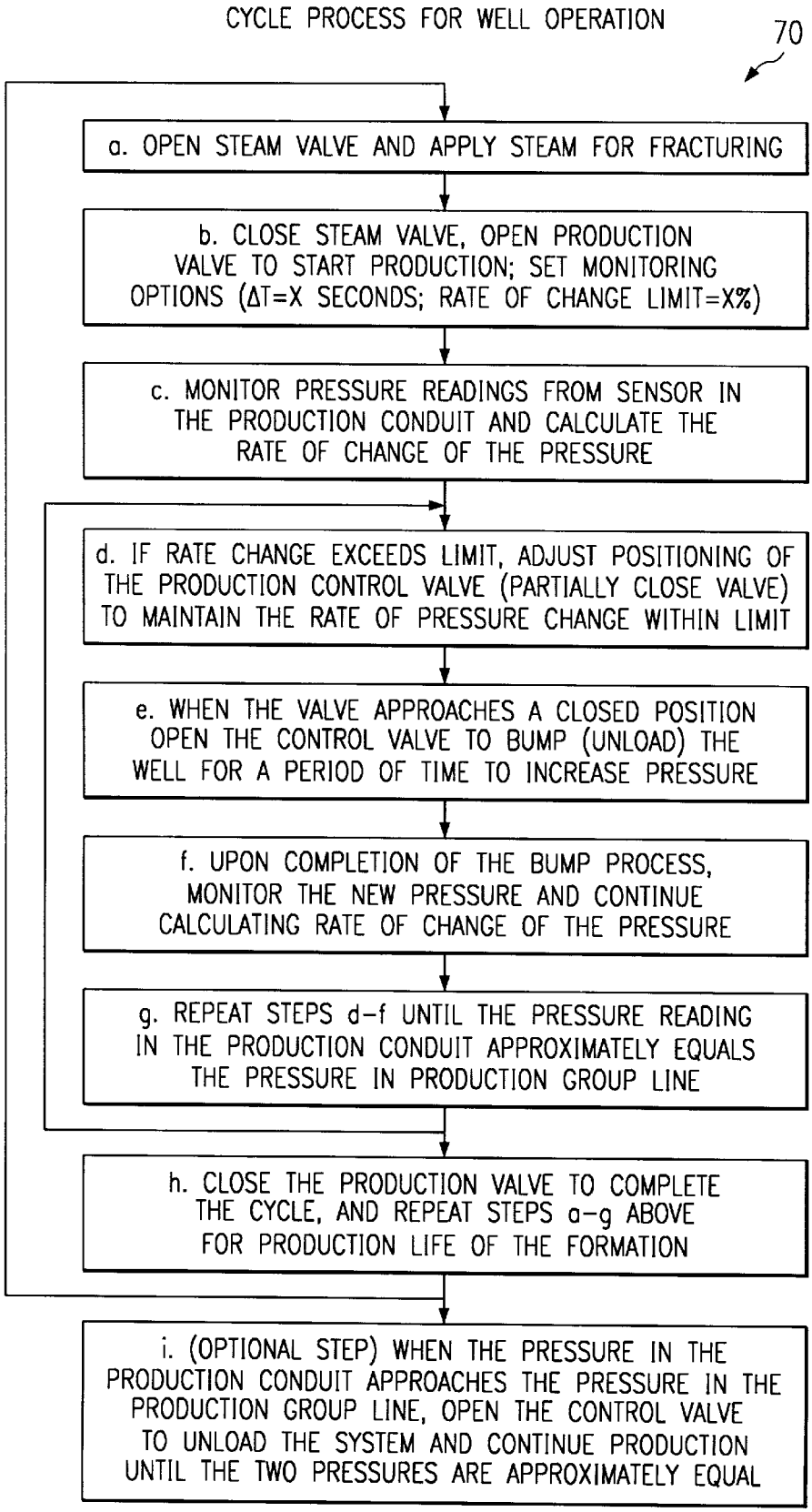
FIG. 2 is a flow chart describing the method of the control system of the present invention.

The process steps for the control system 42 are shown in chart 70 in FIG. 2. The production control valve 52 is opened to initiate production (step 70*b*). The pressure sensor 56 is used to monitor pressure and provide a continuous signal to the computer 50 (step 70*c*). Once the control valve 52 is open and the pressure increases, the computer 50 sets the maximum pressure reading as the initial set point. The computer 50 calculates the rate of change of the pressure and then provides an output signal to the actuator 54 to control the operation of the control valve 52.

In order to achieve optimum production in the well 10, control of the rate of pressure decline during the production operation is an important element. If the production flow is unloaded with little restriction, the production flow rate is acceptable, but the production time during a cycle is too short to achieve optimum production. If the production flow is too restrictive, the production time during a cycle is acceptable, but the flow rate is too slow to achieve optimum production. By monitoring and controlling the rate of pressure decline, the production operation time and production flow rate are more optimal for achieving improved production rate over a reasonable production time period. The present invention provides production output which has a high oil to steam ratio, which also improves the overall operating efficiency of the production system.

In the oil industry, Darcy's Equation can be used to estimate the flow rate of produced fluids. The flow rate is dependent upon the pressure differential between the reservoir pressure and the wellbore pressure. For control purposes, a single pressure reading from pressure sensor 56 in the conduit 44 can be used to approximate such pressure differential. When the pressure at pressure sensor 56 increases, the flow rate from the well 10 increases. When the pressure at pressure sensor 56 decreases, the flow rate decreases.

The preferred rate of pressure decrease for operation of well 10 is generally in the range of 5–20 percent of the pressure reading used for the set point. The most preferred rate of pressure decrease is in the range of 8–12 percent. The time delta used by the computer 50 to calculate the rate of pressure can be adjusted. The preferred range for the time delta is 10–120 seconds, with 60 seconds being a more preferred value. This frequency for calculating the rate of change of the pressure is sufficient for control purposes in this application. The computer 50 continuously compares two pressure output signals from the sensor 56 with a time interval of 60 seconds. If the difference between the first output signal and the second output signal is greater than 10 percent, the computer 50 generates an output control signal to adjust the position of the valve (steps 70*c*–70*d*).

At the start of production operations, the control valve 52 is fully opened and pressure value at the sensor 56 reaches a maximum pressure at the start of the production operations. The pressure is monitored by sensor 56 and the output signal from the sensor 56 is used by computer 50 to calculate the rate of pressure change. When the rate of change is greater than the rate change limit, for example, 10% change in two pressure output signals, the computer 50 generates an output signal to partially close the valve 52. The rate of change of the pressure will decrease, however, the production flow rate will decrease as the valve 52 is closed. The computer 50 will continue to close the control valve 52 until the rate of change of the pressure reaches the desired 10 percent limit. Each time the rate of change exceeds the 10 percent limit, the control valve 52 receives a signal to further close the valve.

As the valve 52 closes further and further, the rate of pressure can no longer be controlled by closing the control valve 52. The computer 50 output signal has a defined range (such as 4–20 ma), such that the corresponding position of the valve 52 can be determined. When the production flow is reduced significantly by the closure of the valve 52, a system "bump" will take place in which the computer 50 opens the control valve to the full open position such that the well is unloaded and the pressure at the sensor 56 increases (step 70*e*). The opening of the valve is will be in a stepped or ramped manner such that the valve will take more than a minute to open. The valve will be kept in the full open position for anywhere from 2–60 minutes with the preferred range being in the 2–15 minute range. The bump time can be adjusted depending on the nature of the well 10. The pressure during the system bump will increase for a short period of time. Once the system bump time is completed, the computer 50 resume monitoring of the rate of change of the pressure and will adjust the positioning of the valve 52 to maintain the desired rate.

At the end of the system bump, the computer 50 detects a new set point to initiate the monitoring of the rate of pressure decline. The new pressure reading from sensor 56 is used as the initial reading for calculating the rate of change (step 70*f*). The percentage limit may be kept the same or altered to reflect the status of the production operations. It is sometimes preferable towards the end of the production cycle to reduce the rate of change percentage used for the triggering point.

The production operations of a operating cycle are typically continued until the pressure in the conduit 44 is approximately equal to the pressure in the production group line 64. As the pressure level in the conduit approaches the pressure level in the production group line 64, the production rate continues to decrease. A pump may be used to increase the production of oil, but it is generally more efficient to repeat the cycle to obtain additional production. The production control valve 52 is closed to complete the cycle, and the steam control valve 46 is opened and the cycle is repeated. The amount of steam to be delivered to the formation 12 can adjusted based on prior performance of the well 10.

The number of system bumps per cycle depends on the well. In some cases, the well 10 will be bumped once an hour during the first few days of production. During the later days of the production operation, the well 10 may be bumped only two or three times per day. The number of bumps depends on the formation 12 and the operating parameters for the production operation. The formation 12 will typically have a number of intervals which are fractured for production operations. The number of cycles for a given interval of the well 10 is also dependent upon local conditions and the operating parameters. Up to 100 cycles may be run for each interval of the well, with 30–50 cycles being a reasonable number of cycles (steps 70*g*, 70*h*).

An additional process step may be implemented at the end of the cycle to increase production (step 70*i*). As the pressure in conduit 44 approaches line pressure, the system 42 can automatically be bumped/unloaded to raise the pressure and increase production. The production operation is nearly complete and the goal is not to increase the production time, but to squeeze the most oil possible from the formation 12 at the end of the cycle. The pressure in the production group line 64 is monitored by pressure sensor 66. When the pressure signal from well conduit sensor 56 reaches a set differential limit for the pressure signal from the production group line sensor 66, the computer 50 will signal the control valve 52 to operate in a full open position. This final bump of the cycle will increase pressure and deliver the maximum amount of oil during the last day(s) of the production operations for the cycle. The pressure differential between the two pressures typically falls within a range of 5–15 psi, with 10 psi being the preferred pressure differential for the final bump of the system. At this point in the operating cycle, controlling the rate of decline is not as important as increasing pressure to obtain greater production.

Figure 3:
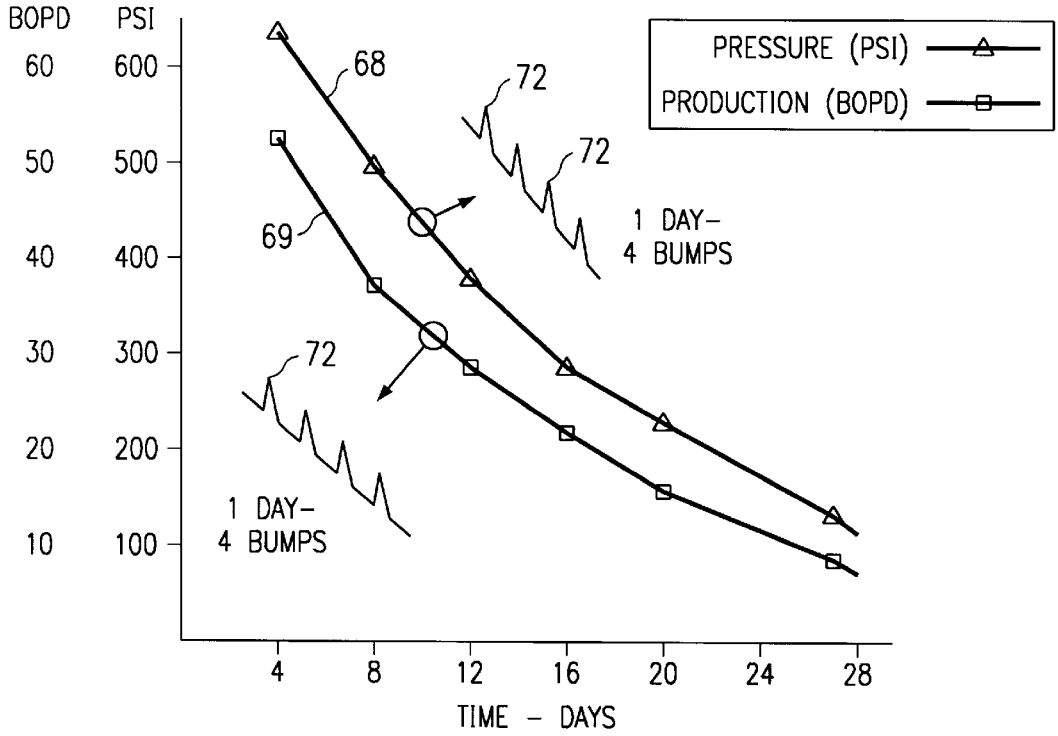
FIGS. 3 and 3A are graphs showing pressure and production levels versus time for a production interval during a well operating cycles.
Figure 3A:
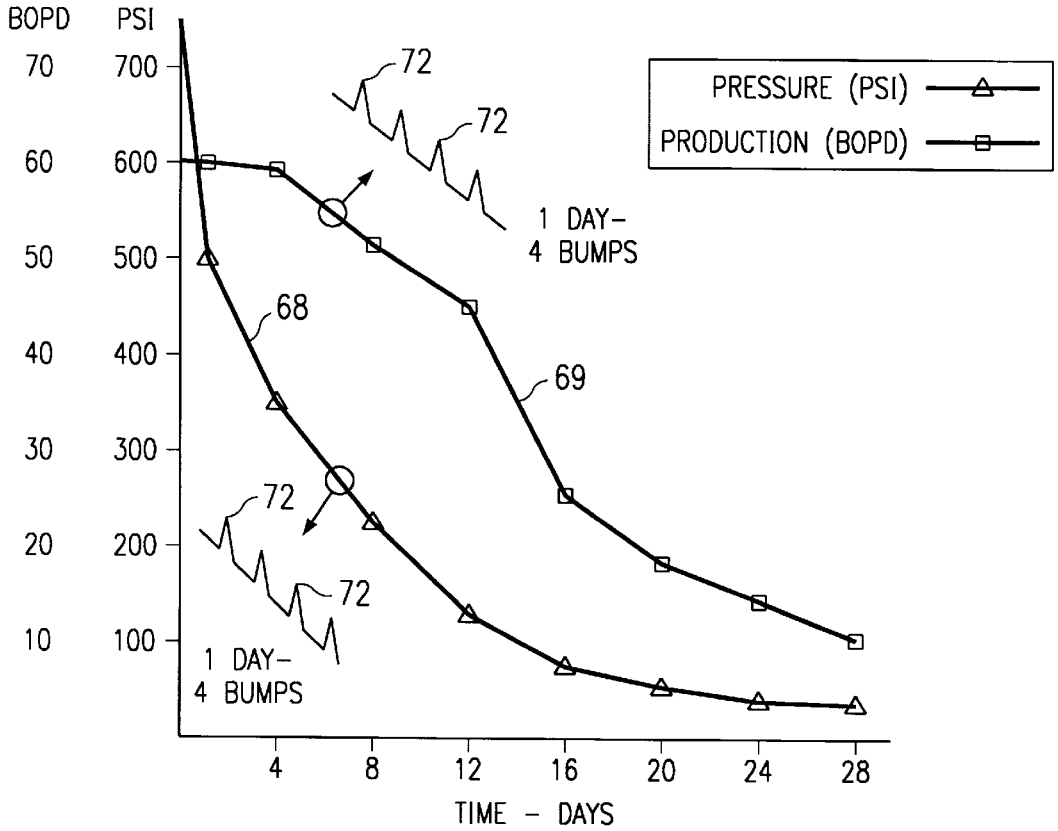

FIGS. 3 and 3A show the relationship during an operating cycle between the pressure and production output with the control system 42 of the present invention. By bumping the system, the well 10 is able to maintain a higher rate of production during the initial days of the production operation. When the pressure curve 68 levels off in the last half of the production operation, the production curve 69 also levels off until production operations are stopped when the production rate is approximately ten barrels of oil per day. During the system bumps, the pressure increases for a short period of time, which provides a saw-tooth pattern 72 to both of the curves. By controlling the rate of pressure decline, the production rate can be maintained at higher rates than with other production methods. Some enhanced recovery processes, such as systems with continuous restriction, may achieve a slightly longer production time in the operation of the well. However, the higher production rates of the present invention more than compensate for any differences in the production time for the operating cycle. Because the present invention can achieve more production in a shorter period of time, the overall efficiency and profitability of the well operations may be increased.

Figure 4:
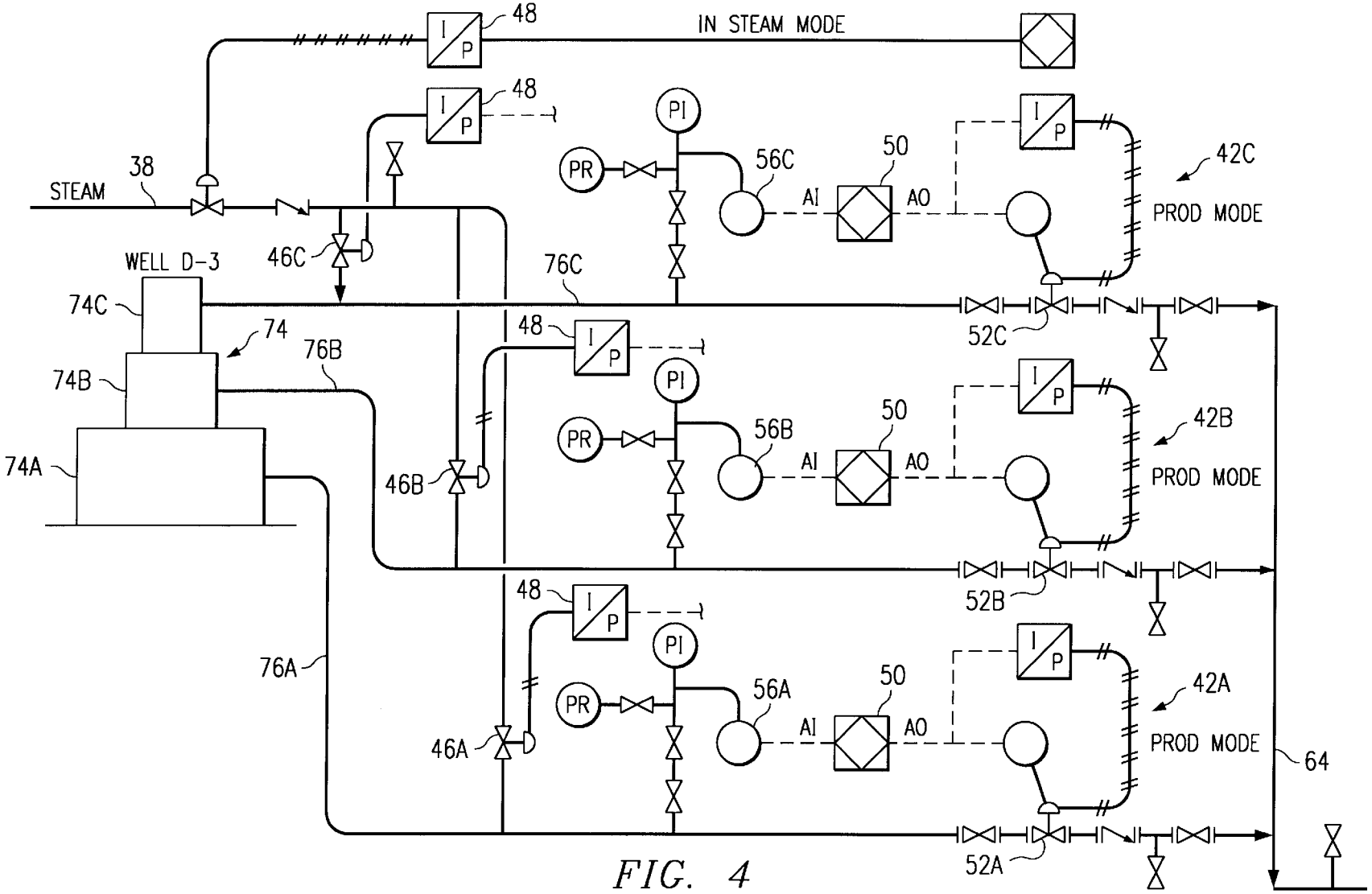
FIG. 4 is a schematic diagram of a multi-completion well from a single wellhead showing three control systems, one for each of the wellbores in the multi-completion wells.

For wells drilled in a diatomite formation, a multiple well construction is known in the prior art. A multiple well 74 shown in FIG. 4 would typically involve the initial drilling of a single, generally vertical wellbore, followed by the drilling of one or more deviated or curved wellbores extending from predetermined points of intersection with the vertical wellbore (not shown). Completion of the respective well bores in multiple well 74 is carried out to provide separate conduits or flow paths for fluids to and from the respective well bores. Conduits 76A, 76B, 76C are connected to the wellbores 74A, 74B, 74C of well 74. A separate control system 42A, 42B, 42C, which is identical to the control system in FIG. 1, is provided for each of the wellbores in that each control system 42A, 42B, 42C includes a steam control valve 46A, 46B, 46C, respectively; a production control valve 52A, 52B, 52C, respectively, and a pressure sensor 56A, 56B, 56C, respectively, all of which operate in the same manner as its respective component in the system of FIG. 1. The conduits 76A, 76B, 76C are connected to the steam supply 38 and the production group line 64.

In a multiple well 74, the steam operations during the operating cycle will not overlap, such that only one of the three wellbores will be receiving steam while the other two wellbores are in production operations. In such a situation, the production wellbores will generally experience an increase in pressure because of offset heat transfer from the wellbore with the steam operation. In addition, pressure in a wellbore may increase due to surging production. The control system 42 of the present invention will not unload such energy, but will detect and monitor such additional pressure in the wellbore. The computer 50 could either open up the control valve to unload the wellbore and provide a higher production rate; or the computer 50 could retain this energy and allow the pressure in the wellbore to rise.

The preferred operation for handling increases in pressure would be to retain such energy and extend the operating time between system bumps. The sensor 56 detects such a pressure increase and sends a signal to the computer 50. The control valve 52 is kept in the same position while the pressure is increasing. Once the pressure in the wellbore is no longer increasing and has resumed its normal downward slope, the computer 50 continues to calculate the rate of change in the pressure decrease based on the latest signals from the sensor 56. This effectively establishes a new set point for calculating the rate of pressure decrease. Once the rate of decrease in the pressure exceeds the specified limit, the computer 50 will adjust the position of the control valve 52.

Figure 5:
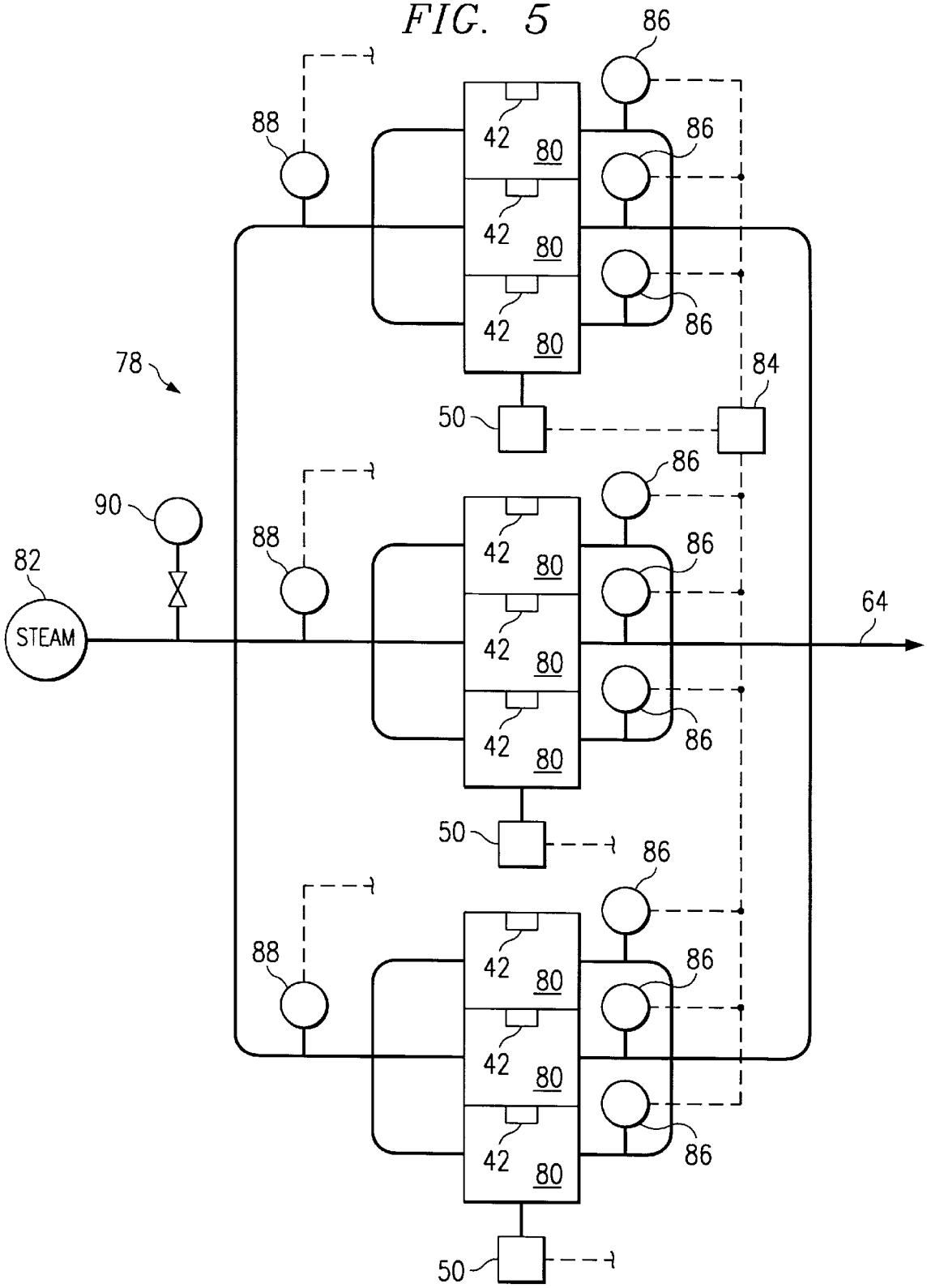
FIG. 5 is a schematic diagram showing the steam delivery system for a plurality of multi-completion wells.

Referring now to the schematic of a well field 78 shown in FIG. 5, production field operation for wells 80 is often constrained by the capacity of the centralized processing facilities, such as the steam generating facility 82 which supplies steam to the various wells 80 in the field 78. The maximizing of oil production at individual wells may require more steam than can be provided by the steam facility 82. Steam operations are made more complex by variations in well maturity over the plurality of wells in the production field in combination with steam capacity. Because well maturity varies from well to well over the production field 78, production management decision for operation of the steam generation system 82 and allocation of the steam are continuously adjusted on a well by well basis.

The wells in a modern production field are linked together by a network of surface lines which transport the produced gas, oil, and water from each of the wells to the centralized processing facilities. In large production fields, the wellhead pressure is determined by the oil, water, and gas loads from other wells at the same drill site, from other drill sites, and from the capacity of the central processing facilities, relative to the field production. This complex interaction of the wells 80 with one another, and with the capacity of the steam processing facility 82 further complicates the optimization of well production.

In most fields, and especially fields in remote locations, the significant cost of installing and operating equipment, such as the steam generation facility 82, results in production limitations. It is also contemplated that the preferred embodiment of the present invention will be particularly applicable to the situation of multiple wells 80 and steam generating facilities 82 are controlled by a field computer 84.

In operating the individual wells 80, the computer 84 or other the expert system controller confirms where a well 80 is operating in a operating cycle, including steaming operations and production operations. Each of the wells includes a control system 42 as discussed above. When steam is to be supplied, another consideration for the computer 84 is the amount of steam to be supplied to the well 80. When the control system 42 and the computer for a well is a single unit operating independently, the primary responsibility of the computer is to control the steam and the rate of decrease of the pressure to optimize production. When a number of wells 80 are controlled by a computer 84 on the field level and when steam capacity is limited, the decisions whether to produce or temporarily shut down the well 80, whether to apply steam to the well 80, and how much steam to apply to the well, are more complex. In some instances, a single computer 84 will control all of the wells. Alternatively, individual wells or groups of wells may be controlled by a computer 50 and then computer 50 may communicate with the main computer 84 for the drill site.

Based on the input from the production control systems 42, the flow meters 86, and the steam pressure sensors 88, 90, the computer 84 initiates control actions to optimize production. When the steam system is operating at full capacity and results is production decreases when the steam capacity is exceeded, the initial consideration is whether to operate the well or to temporarily shut the well in. If the well is shifting from production operation steam operation in a production cycle, then the decision must be made as to how much steam to allocate to the steam operation to fracture the well. As the operating experience and knowledge base is expanded, the operating decisions will improve and more complex operations can be accomplished.

The present invention includes a field computer 84 which is in communication with the pressure sensors in the control system 42 and/or the well computers 50 used to operate the individual wells 80 of a field 78. The field computer also is in communication with the control system for the steam generation facilities 82 and pressure sensors 88,90. Flow meters 86 or other instrumentation is used to measure the production output of the wells 80. The computer 84 will analyze the production output of the wells 80, the pressure readings during production operations, the amount of steam and the length time for the steam operations for each cycle, The computer 84 will then control the steam allocation and override the cycle time schedules of the individual computers 50 in order to maximize production from the field 78 through the production group line 64. The wells 80 with the highest production output will be given priority to the steam supply. Marginal wells near the end of their production life will be given lower priority for steam if demand exceeds supply. As steam operations are completed for certain wells 80 and steam capacity is available, steam will be delivered to the marginal wells to begin an operating cycle for the production of oil from the well.

While the present invention has been illustrated and described in terms of specific apparatus and methods of use, it is apparent that various modifications can be made therein within the scope of the present invention as defined by the appended claims.

What is claimed is:

1. A method for recovering hydrocarbons from a low permeability formation through a well to a conduit and into a production line by an operating cycle comprising a fracturing operation and a production operation, said method comprising the steps of:

(a) stimulating a formation containing hydrocarbons by injecting a heated fluid through the conduit, the well, and into the formation adjacent the well during the fracturing operation;

(b) producing hydrocarbons from said formation through the same well and conduit during said production operation and including the steps of:

(1) monitoring pressure as the hydrocarbons are passing through the well and the conduit, and transmitting signals from a pressure sensor to a computer;

(2) calculating a rate of change in the pressure based on said signals transmitted from the pressure sensor to the computer;

(3) comparing the rate of change in the pressure to an upper limit for a decreasing rate of change in the pressure, which upper limit is input into the computer;

(4) generating an output signal from the computer to a control valve when the rate of change in the pressure exceeds the upper limit;

(5) adjusting the positioning of the control valve to maintain the rate of pressure change within the upper limit;

(6) opening the control valve for a period of time to bump the pressure at the sensor; and (7) repeating steps (b)(1)–(b)(6) for at least one additional production cycle.

2. The method of claim 1, wherein the heated fluid is steam.

3. The method of claim 2, wherein the fracturing operation occurs over a period of one to four days.

4. The method of claim 1, wherein the pressure is detected in the conduit adjacent a wellhead at the well.

5. The method of claim 1, wherein the rate of change in the pressure is ten percent or less.

6. The method of claim 1, wherein the period of time to bump the well is between one and sixty minutes.

7. The method of claim 1, including the additional steps of (b)(8) calculating a pressure differential between the pressure in the conduit with a pressure in the production line; and (b)(9) fully opening the control valve when the pressure differential decreases to a selected limit, thereby completing the production operations.

8. The method of claim 1, including the additional step of adjusting the upper limit for the rate of change in the pressure during the production operations.

9. The method of claim 1, wherein step (b)(3) includes a second upper limit for an increasing rate of change in the pressure, and wherein steps (b)(4–5) include the generating of an output signal when either upper limit is exceeded and the adjusting of the position of the control valve to maintain the rate of change in the pressure between the two limits.

10. A method for recovering hydrocarbons from a low permeability formation through a well to a conduit and into a production line by an operating cycle comprising a fracturing operation and a production operation, said method comprising the steps of:

(a) stimulating a formation containing hydrocarbons by injecting a heated fluid through said conduit, said well, and into said low permeability formation adjacent said well during said fracturing operation;

(b) producing hydrocarbons from said formation through said well and said conduit during said production operation, said production operation including the steps of:

(1) monitoring the pressure of said hydrocarbons as said hydrocarbons are produced through said well and said conduit and generating signals representative of said pressure at timed intervals;

(2) transmitting said signals to a computer;

(3) calculating in said computer a rate of change in said pressure by taking the difference between the pressures represented by two successive signals;

(4) comparing said calculated rate of change to a preferred limit of pressure rate change which is input into said computer;

(5) generating an output signal from the computer to a control valve when the calculated rate of change exceeds said preferred limit;

(6) closing said control valve in response to said output signal to maintain the rate of change in the pressure within the preferred limit;

(7) opening the control valve for a period of time to bump the pressure at the sensor when said control valve has been closed to the extent that the production of said hydrocarbons drops below a desired flowrate; and (7) repeating steps (b)(1)–(b)(7) for at least one additional production cycle.

11. The method of claim 10 wherein said preferred limit of pressure rate change is reset to a new value after said control valve has been opened for said period of time.

* * * * *